US007126263B2

(12) United States Patent
Peck

(10) Patent No.: US 7,126,263 B2
(45) Date of Patent: Oct. 24, 2006

(54) PERFORATED MEGA-BOULE WAFER FOR FABRICATION OF MICROCHANNEL PLATES (MCPS)

(75) Inventor: Thomas N. Peck, Roanoke, VA (US)

(73) Assignee: ITT Manufacturing Enterprises Inc., Wilmington, DE (US)

( * ) Notice: Subject to any disclaimer, the term of this patent is extended or adjusted under 35 U.S.C. 154(b) by 393 days.

(21) Appl. No.: 10/727,704

(22) Filed: Dec. 3, 2003

(65) Prior Publication Data

US 2005/0122020 A1 Jun. 9, 2005

(51) Int. Cl.
*H01J 43/00* (2006.01)

(52) U.S. Cl. ..... 313/103 CM; 313/105 CM; 250/207; 385/120; 385/115; 385/116; 428/188

(58) Field of Classification Search ..... 313/103 CM, 313/105 CM; 250/207, 214 VT; 385/115–118, 385/120; 428/113, 131, 137, 188
See application file for complete search history.

(56) References Cited

U.S. PATENT DOCUMENTS 4,912,314 A 3/1990 Sink 6,064,055 A 5/2000 Dorko

*Primary Examiner*—Ashok Patel
*Assistant Examiner*—Anthony Canning
(74) *Attorney, Agent, or Firm*—RatnerPrestia

(57) ABSTRACT

A mega-boule is used in fabricating microchannel plates (MCPs). The mega-boule has a cross-sectional surface including an island section, an inner perimeter section and an outer perimeter section, each section occupying a distinct portion of the cross-sectional surface. The island section is formed of a first plurality of optical fibers, transversely oriented to the cross-sectional surface, each optical fiber including a cladding formed of non-etchable material and a core formed of etchable material. The inner perimeter section is formed of non-etchable material and is disposed to surround the island section. The outer perimeter section is formed of a second plurality of optical fibers, transversely oriented to the cross-sectional surface, each optical fiber including a cladding formed of non-etchable material and a core formed of etchable material, and the outer perimeter section is disposed to surround the island section and the inner perimeter section. The first plurality of optical fibers of the island section form transverse microchannels for an MCP, when the island section is etched, and the second plurality of optical fibers of the outer perimeter section form perforated cleave planes, when the outer perimeter section is etched.

10 Claims, 5 Drawing Sheets

PERFORATED MEGA-BOULE WAFER FOR FABRICATION OF MICROCHANNEL PLATES (MCPS)

TECHNICAL FIELD

The present invention relates to microchannel plates (MCPs) for use in image intensifiers, and more specifically, to a device and method for fabrication of multiple MCPs using a perforated mega-boule wafer.

BACKGROUND OF THE INVENTION

Microchannel plates are used as electron multipliers in image intensifiers. They are thin glass plates having an array of channels extending there through and are located between a photocathode and a phosphor screen. An incoming electron from the photocathode enters the input side of the microchannel plate and strikes a channel wall. When voltage is applied across the microchannel plate, these incoming or primary electrons are amplified, generating secondary electrons. The secondary electrons then exit the channel at the back end of the micrcochannel plate and are used to generate an image on the phosphor screen.

In general, fabrication of a microchannel plate starts with a fiber drawing process, as disclosed in U.S. Pat. No. 4,912,314, issued Mar. 27, 1990 to Ronald Sink, which is incorporated herein by reference in its entirety. For convenience, FIGS. 1–4, disclosed in U.S. Pat. No. 4,912,314, are included herein and discussed below.

In FIG. 1 there is shown a starting fiber 10 for the microchannel plate. Fiber 10 includes glass core 12 and glass cladding 14 surrounding the core. Core 12 is made of glass material that is etchable in an appropriate etching solution. Glass cladding 14 is made from glass material which has a softening temperature substantially the same as the glass core. The glass material of cladding 14 is different from that of core 12, however, in that it has a higher lead content, which renders the cladding non-etchable under the same conditions used for etching the core material. Thus, cladding 14 remains after the etching of the glass core. A suitable cladding glass is a lead-type glass, such as Corning Glass 8161.

The optical fibers are formed in the following manner: An etchable glass rod and a cladding tube coaxially surrounding the rod are suspended vertically in a draw machine which incorporates a zone furnace. The temperature of the furnace is elevated to the softening temperature of the glass. The rod and tube fuse together and are drawn into a single fiber 10. Fiber 10 is fed into a traction mechanism in which the speed is adjusted until the desired fiber diameter is achieved. Fiber 10 is then cut into shorter lengths of approximately 18 inches.

Several thousands of the cut lengths of single fiber 10 are then stacked into a mold and heated at a softening temperature of the glass to form hexagonal array 16, as shown in FIG. 2. As shown, each of the cut lengths of fiber 10 has a hexagonal configuration. The hexagonal configuration provides a better stacking arrangement.

The hexagonal array, which is also known as a multi assembly or a bundle, includes several thousand single fibers 10, each having core 12 and cladding 14. Bundle 16 is suspended vertically in a draw machine and drawn to again decrease the fiber diameter, while still maintaining the hexagonal configuration of the individual fibers. Bundle 16 is then cut into shorter lengths of approximately 6 inches.

Several hundred of the cut bundles 16 are packed into a precision inner diameter bore glass tube 22, as shown in FIG. 3. The glass tube has a high lead content and is made of a glass material similar to glass cladding 14 and is, thus, non-etchable by the etching process used to etch glass core 12. The lead glass tube 22 eventually becomes a solid rim border of the microchannel plate.

In order to protect fibers 10 of each bundle 16, during processing to form the microchannel plate, a plurality of support structures are positioned in glass tube 22 to replace those bundles 16 which form the outer layer of the assembly. The support structures may take the form of hexagonal rods of any material having the necessary strength and the capability to fuse with the glass fibers. Each support structure may be a single optical glass fiber 24 having a hexagonal shape and a cross-sectional area approximately as large as that of one of the bundles 16. The single optical glass fiber, however, has a core and a cladding which are both non-etchable. The optical fibers 24, or support rods 24, are illustrated in FIG. 3, as being disposed at the periphery of assembly 30 and surrounding the plurality of bundles 16.

The support rods may be formed from one optical fiber or any number of fibers up to several hundred. The final geometric configuration and outside diameter of one support rod 24 is substantially the same as one bundle 16. The multiple fiber support rods may be formed in a manner similar to that of forming bundle 16.

Each bundle 16 that forms the outermost layer of fibers in tube 22 is replaced by a support rod 24. This is preferably done by positioning one end of a support rod 24 against one end of a bundle 16 and then pushing support rod 24 against bundle 16, until bundle 16 is out of tube 22. The assembly formed when all of the outer bundles 16 have been replaced by support rods 24 is called a boule, and is generally designated as 30 in FIG. 3.

Boule 30 is fused together in a heating process to produce a solid boule of rim glass and fiber optics. The fused boule is then sliced, or diced, into thin cross-sectional plates. The planar end surfaces of the sliced fused boule are ground and polished.

In order to form the microchannels, cores 12 of optical fibers 10 are removed, by etching with dilute hydrochloric acid. After etching the boule, the high lead content glass claddings 14 remains to form microchannels 32, as illustrated in FIG. 4. Also, support rods 24 remain solid and provide a good transition from the solid rim of tube 22 to microchannels 32.

Additional process steps include beveling and polishing of the glass boule. After the plates are etched to remove the core rods, the channels in the boule are metallized and activated.

As described, the current method of manufacturing an MCP includes stacking multiple bundles, and then placing the stacked bundles within a sheath of rim glass. The supporting rods of non-etchable fibers are then used to fill the interstitial space between the bundles of etchable fibers and the rim glass (tube 22) to form a boule. The boule is then sliced at an angle into thin wafers to produce a bias angle. The wafers are then etched, hydrogen fired to form a conduction layer, and metallized to provide electrical contact.

After the boule is sliced into wafers, each wafer is handled individually. A typical size of the wafer is approximately 1 inch diameter. This is much smaller than the wafer size of current semiconductor processing tools and necessitates use of custom fabrication processing tools. Handling each boule wafer individually leads to large amounts of touch labor for a part very sensitive to particle contamination. The yield of these wafers is, therefore, reduced.

The present invention addresses the need for fabricating MCPs using more efficient fabrication methods and for methods that are less subject to contamination and reduced yield.

SUMMARY OF THE INVENTION

To meet this and other needs, and in view of its purposes, the present invention provides a mega-boule for use in fabricating microchannel plates (MCPs). The mega-boule comprises a cross-sectional surface including an island section, an inner perimeter section and an outer perimeter section, each section occupying a distinct portion of the cross-sectional surface. The island section is formed of a first plurality of optical fibers, transversely oriented to the cross-sectional surface, each optical fiber including a cladding formed of non-etchable material and a core formed of etchable material. The inner perimeter section is formed of non-etchable material and is disposed to surround the island section. The outer perimeter section is formed of a second plurality of optical fibers, transversely oriented to the cross-sectional surface, each optical fiber including a cladding formed of non-etchable material and a core formed of etchable material, and the outer perimeter section is disposed to surround the island section and the inner perimeter section. The mega-boule also includes at least another section occupying a distinct portion of the cross-sectional surface. The other section is formed of non-etchable material, and is separated from the inner perimeter section by the outer perimeter section. The first plurality of optical fibers of the island section form transverse microchannels for an MCP, when the island section is etched, and the second plurality of optical fibers of the outer perimeter section form perforated cleave planes, when the outer perimeter section is etched. The outer perimeter section and the island section form an MCP, and the outer perimeter section includes a sufficient cross-sectional width for forming perforated cleave planes to break away the MCP from the mega-boule, and for preventing the MCP die accidentally breaking away during fabrication of the MCP.

In another embodiment, the present invention includes a method of fabricating microchannel plates (MCPs) comprising the steps of: (a) providing bundles of optical fibers, wherein each optical fiber includes a cladding formed of non-etchable material and a core formed of etchable material; (b) stacking a plurality of the bundles to form at least one island section, defining a mini-boule; (c) stacking non-etchable material to surround the mini-boule and form an inner section that surrounds the mini-boule; (d) stacking etchable material to surround the inner section and form an outer section that surrounds the inner section; (e) stacking additional non-etchable material to surround the outer section and form an exterior section; and (f) fusing the mini-boule, the inner section, the outer section and the exterior section to form a mega-boule for use in fabricating the MCPs. The method may further include the steps of: (g) dicing the mega-boule to form multiple mega-boule wafers, each mega-boule wafer defining a batch die; and (h) activating, and metallizing a mega-boule wafer for forming the MCPs. Step (h) may also include etching an outer section of the mega-boule wafer to form perforated cleave planes, and breaking the perforated cleave planes to extract an MCP from the mega-boule wafer.

In yet another embodiment, the present invention includes a method of fabricating microchannel plates (MCPs) comprising the steps of: (a) stacking etchable and non-etchable optical materials to form a plurality of mini-boules, the mini-boules separated from each other and forming separate islands along a cross-sectional surface; (b) stacking non-etchable optical material to surround the plurality of mini-boules and form a plurality of inner perimeter sections along the cross-sectional surface, each surrounding a corresponding mini-boule; (c) stacking etchable and non-etchable optical materials to surround the plurality of inner perimeter sections and form a plurality of outer perimeter sections along the cross-sectional surface, each surrounding a corresponding inner perimeter section; and (d) fusing the stacked etchable and non-etchable optical materials of steps (a)–(c) to form a mega-boule for use in fabricating the MCPs. Step (c) may include stacking additional non-etchable material to surround the plurality of outer perimeter sections and form an exterior section along the cross-sectional surface. Step (a) may include stacking optical fibers, each optical fiber having a cladding formed of non-etchable material and a core formed of etchable material. Step (c) may include stacking optical fibers, each optical fiber having a cladding formed of non-etchable material and a core formed of etchable material. The method may further include the step of: (e) etching at least one outer perimeter section of the plurality of outer perimeter sections to form perforated cleave planes in the one outer perimeter section for breaking away an island and an inner perimeter section disposed within the one outer perimeter section.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

Figure 5:
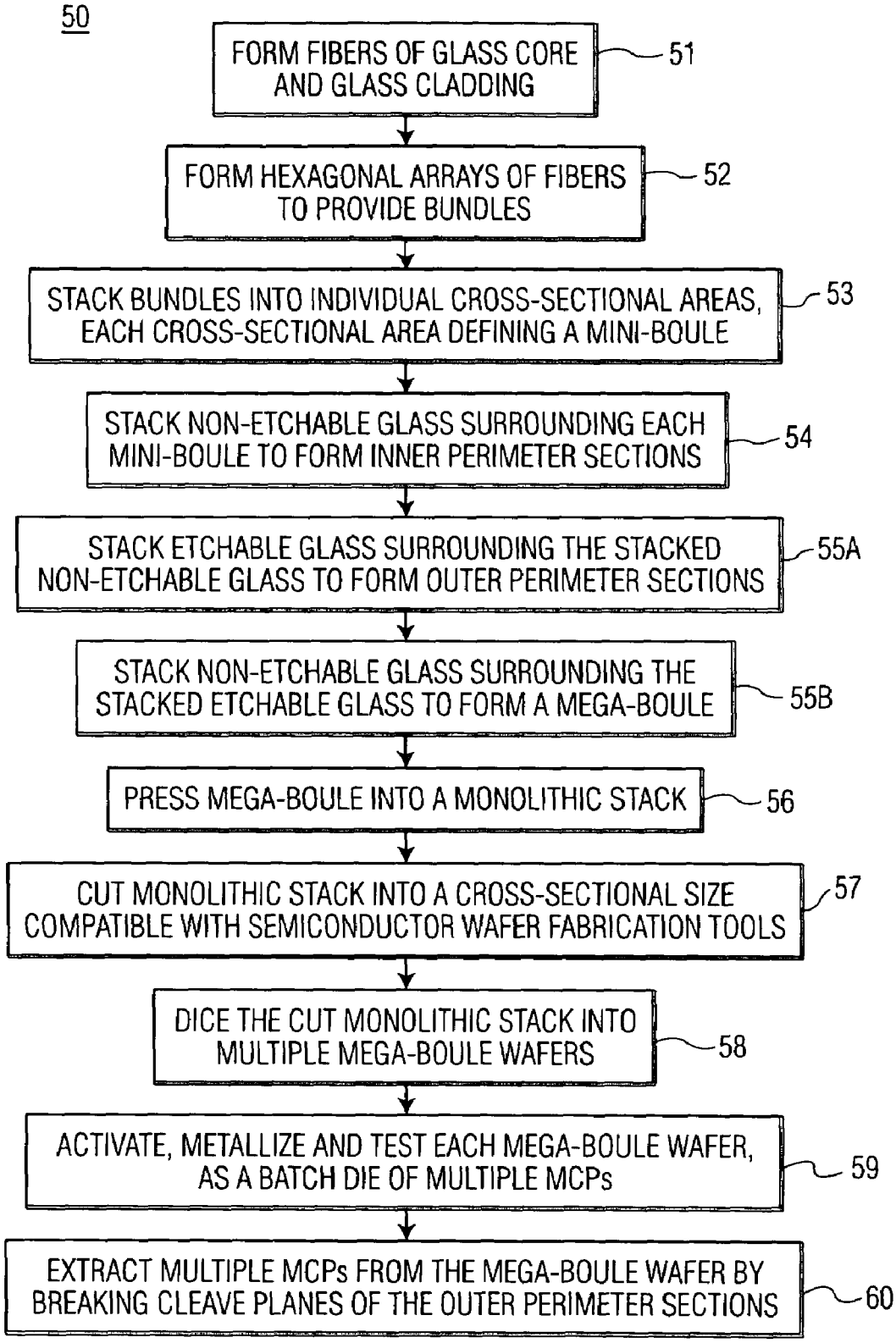
FIG. 5 is a flow diagram illustrating a method for fabricating microchannel plates using a mega-boule wafer, in accordance with the present invention.

The present invention relates to forming a plurality of MCPs by using a method amenable to conventional wafer fabrication tools. More specifically, an embodiment of a method of the present invention is shown in FIG. 5, and is generally designated by reference numeral 50. As will be explained, the method forms a batch die for making multiple MCPs from a single large wafer. The single large wafer, referred to as a mega-boule wafer, is sized to be accommodated by conventional wafer fabrication tools.

Figure 1:
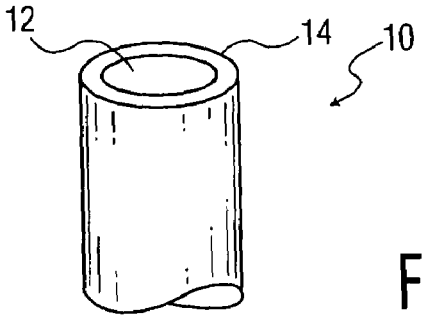
FIG. 1 is a partial view of a fiber used in fabricating microchannel plates in accordance with the present invention.

Referring now to FIG. 5 and beginning with step 51, fibers of glass core and glass cladding are formed by method 50. Starting fiber 10 is shown in FIG. 1 and includes glass core 12 and glass cladding 14. Core 12 is made of material that is etchable, so that the core may be subsequently removed by etching a mega-boule wafer, in accordance with the present invention. Glass cladding 14 is made of glass that is non-etchable under the same conditions that allow etching of core 12. Thus, each cladding remains after the etching process, and becomes a boundary for a microchannel that forms upon removal of a corresponding core.

As discussed before, a suitable cladding glass is a lead-type glass, such as Corning Glass 8161. In subsequent stages of the inventive process, using conventional fabrication tools on the mega-boule wafer, the lead oxide is reduced to activate the inner surfaces of each of the glass claddings, so that they are capable of emitting secondary electrons.

As described in U.S. Pat. No. 4,912,314, which is incorporated herein by reference in its entirety, optical fibers 10 are formed in the following manner: An etchable glass rod and a cladding tube coaxially surrounding the glass rod are suspended vertically in a draw machine which incorporates a zone furnace. The temperature of the furnace is elevated to the softening temperature of the glass. The rod and tube fuse together and are drawn into a single fiber 10. The fiber is fed into a traction mechanism, where the speed is adjusted until the desired fiber diameter is achieved. Fiber 10 is then cut into shorter lengths of approximately 18 inches.

Figure 2:
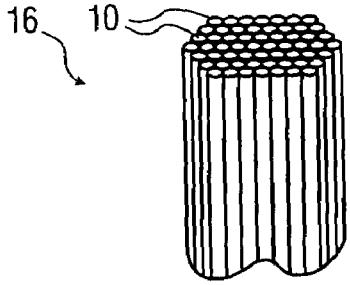
FIG. 2 is a partial view of a bundle of fibers shown in FIG. 1 for use in fabricating microchannel plates in accordance with the present invention.

The method next enters step 52 and forms multiple hexagonal arrays of fibers 10 to define multiple bundles 16, as shown in FIG. 2. Several thousands of the cut lengths of a single fiber 10 are stacked into a mold and heated at the softening temperature of the glass in order to form each hexagonal array, wherein each of the cut lengths of fiber 10 has a hexagonal configuration. It will be appreciated that the hexagonal configuration provides a better stacking arrangement. In addition to the hexagonal configuration, other configurations may also be used, such as a triangular configuration and a rhombohedral configuration.

The hexagonal array 16, which is also referred to as a multi assembly or as a bundle, includes several thousand single fibers 10, each having core 12 and cladding 14. This bundle 16 is suspended vertically in a draw machine and drawn to again decrease the fiber diameter while still maintaining the hexagonal configuration of the individual fibers. The bundle 16 is then cut into shorter lengths of approximately 6 inches.

Several hundred of the cut bundles 16 are then stacked by step 53 of the inventive method to form individual larger stacks, each having a predetermined cross-sectional area. Each larger stack of the predetermined cross-sectional area containing the bundles is referred to herein as a mini-boule. The stacking continues in step 54 by also stacking non-etchable glass (also referred to herein as support rods) so that the non-etchable glass surrounds each mini-boule. Multiple mini-boules may be stacked together, and multiple support rods may be stacked between the mini-boules and stacked to surround the peripheries of each of the mini-boules. In this manner, each mini-boule is separated from each other mini-boule by the support rods or by non-etchable glass.

Figure 6:
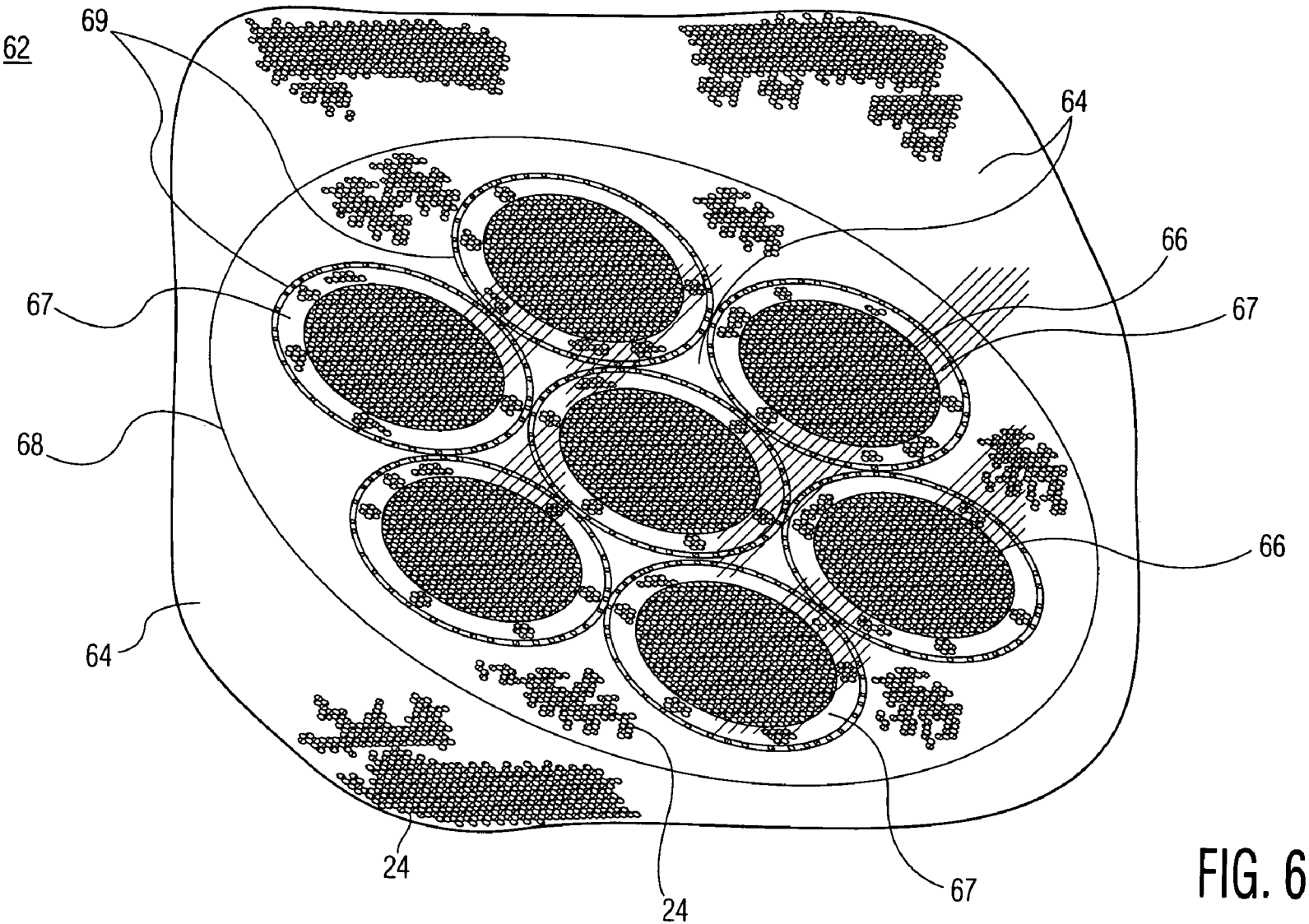
FIG. 6 is a cross-sectional view of a monolithic stack, including a cross-sectional view of a mega-boule cut from the monolithic stack, in accordance with the present invention.

As shown in FIG. 6, mini-boules 66 are stacked to have a circular cross-sectional area (for example). As another example (FIG. 9), each mini-boule may be stacked into a rectangular cross-sectional area.

Method 50 continues in step 54 to stack non-etchable glass, such as support rods, surrounding each mini-boule. In this manner, the non-etchable glass forms a perimeter section around each mini-boule. As shown in FIG. 6, mini-boules 66 are islands, and each island is surrounded by inner perimeter section 67 comprised of non-etchable support rods 24.

Referring again to FIG. 5, step 55A stacks etchable glass surrounding the stacked non-etchable glass to form another perimeter section around each mini-boule. Step 55B then stacks non-etchable glass surrounding the etchable glass stacked in step 55A. As shown in FIG. 6, the stacking forms, in sequence, mini-boules 66, inner perimeter sections 67 of non-etchable support rods 24 and outer perimeter sections 69 of etchable glass.

The method continues stacking non-etchable support rods 24 in section 64 surrounding outer perimeter sections 69 to form mega-boule 62. The stacking may continue until a cross-sectional area of a predetermined size is reached. The predetermined cross-sectional size is a function of a size that may be accommodated by conventional wafer fabrication tools.

Mega-boule 62 includes interstitial area 64 and inner perimeter sections 67 comprised of multiple non-etchable support rods. Each non-etchable support rod 24 has a high lead content and is made of a glass material which is similar to glass cladding 14 and is, thus, non-etchable by the process used to etch away glass core 12. The non-etchable glass has a coefficient of expansion which is approximately the same as that of fibers 10. The non-etchable glass of support rods 24, after the method of the invention is completed, eventually becomes a solid rim border of each fabricated microchannel plate (shown as inner perimeter sections 67 in FIG. 6).

It will be appreciated that the non-etchable support rods provide a support structure to protect each mini-boule 66. Each support rod may take the form of a hexagonal rod (for example) of any material having the necessary strength and the capability to fuse with the etchable glass fibers. The material of the support rods have a temperature coefficient close enough to that of the etchable glass fibers to prevent distortion of the latter during temperature changes.

Figure 3:
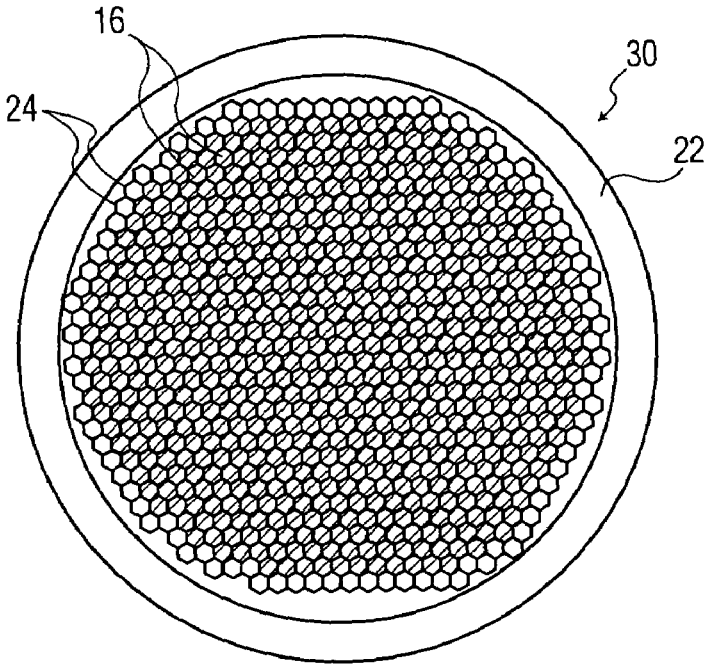
FIG. 3 PRIOR ART
FIG. 3 is a cross-sectional view of a packed boule in accordance with the prior art.

In one embodiment, each support rod may be a single optical glass fiber 24 (FIGS. 3 and 6) of hexagonal shape (for example) and of cross-sectional area approximately as large as that of one of the bundles 16. Of course, the single optical fiber may have a core and a cladding which are both non-etchable under the aforementioned conditions. The optical support fibers 24 are schematically illustrated in FIG. 6. Both the core and the cladding of support rods 24 are made of the same high lead content glass material as the material of glass claddings 14 of fibers 10. These support rods 24 form a cushioning layer and a separation space between each mini-boule 66 formed on mega-boule 62.

In other embodiments of the invention, the support rods may have a cross sectional shape other than an hexagonal shape, so long as the resulting shape of the support rods does not produce interstitial voids. For example, support rods having a triangular shape or a rhombohedral shape are likely not to result in interstitial voids. Accordingly, these shapes may also be used.

The glass rod and tube which forms the core and the cladding of support rod 24 are suspended in a draw furnace and heated to fuse the rod and tube together, and to soften the fused rod and tube sufficiently to form each support rod 24. The so formed support rod 24 is then cut into lengths of approximately 18 inches and subjected to a second draw to achieve the desired geometric configuration and smaller outside cross-sectional diameter that is substantially the same as the outside cross-sectional diameter of bundle 16. The support rods may also be formed from one optical fiber or any number of optical fibers up to several thousand fibers. The final geometric configuration and outside diameter of one support rod being substantially the same as one bundle 16. It will be appreciated that the support rods may be replaced by any other glass rods of any size and shape, so long as the support rods are of material that is non-etchable and able to fuse upon heating with the etchable bundles.

Figure 9:
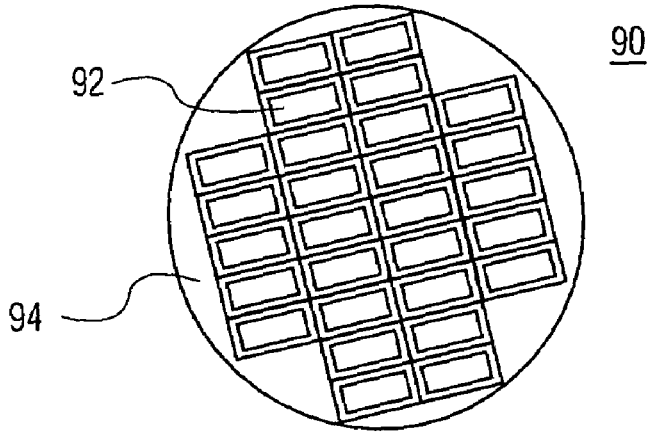
FIG. 9 is a cross-sectional view of a 4-inch semiconductor mega-boule. wafer, illustrating that 28 rectangular MCPs may be extracted from the batch die, in accordance with the present invention.

It will be appreciated that the cross-sectional area of mini-boule 66 may be stacked, as large as desired by a user, for providing a corresponding individual MCP of a predetermined active cross-sectional area. It will also be appreciated that the cross-sectional area of mini-boule 66 may define a circular surface, as shown in FIG. 6, or a cross-sectional area defining a different geometry, such as a rectangular surface, as shown in FIG. 9.

Mega-boule 62 includes multiple outer perimeter sections 69, one outer perimeter section 69 for each mini-boule 66, as shown in FIG. 6. Each outer perimeter section 69 may be comprised of a stack of bundles 16. Each bundle 16 includes many fibers 10, each having core 12 and cladding 14. The bundles are cut into lengths of approximately 6 inches and stacked in step 55A to form outer perimeter section 69 surrounding inner perimeter section 67.

It will be appreciated that the outer perimeter sections may be comprised of many single optical glass fibers of hexagonal shape and of cross-sectional area approximately as large as, or larger than that of one of the bundles 16. The single optical glass fiber may have an etchable glass core and a non-etchable glass cladding.

As will be explained, each outer perimeter section 69 provides a perforated wafer cleave plane, when subjected to an etching process. The individual mini-boules 66 and their surrounding inner perimeter sections 67 (eventually forming MCPs) may then be extracted from mega-boule 62. The extraction may be performed by placing a differential pressure along the perforation, so that the individual MCP dies are broken away from mega-boule 62.

It will be appreciated that the invention also contemplates a single stacked row of optical glass fibers of predetermined thickness forming outer perimeter sections 69. The optical glass fibers may each have an etchable glass core and a non-etchable glass cladding. After etching of the glass cores, the non-etchable glass claddings provide a perforated wafer cleave plane (or several planes) to permit breaking away the individual MCPs from mega-boule 62.

The invention also contemplates a stacked row of etchable glass rods of predetermined thickness forming outer perimeter sections 69. In this embodiment, the glass rods have etchable glass cores and are without non-etchable glass claddings. After etching of the glass rods, the individual MCPs may separate from mega-boule 62, without application of pressure.

In another application, titled "Device and Method for Fabrication of MCPs Using a Mega-Boule Wafer", Ser. No. 10/727761, filed concurrently with this application, there is described a scribing process for freeing the individual MCPs from the large mega-boule. This other application is incorporated herein in its entirety by reference. In the present application, the scribing process, or extracting process, is advantageously performed by breaking the cleave planes, without laser scribing, for example.

It will be appreciated that in semiconductor wafer processing, the single crystal wafers have cleave planes characteristic of the crystal structure. Along these cleave planes, the single crystal may be easily broken by crack propagation. In the mega-boule wafer, these characteristic cleavage planes do not exist, owing to the nature of the man-made structure. The individual MCP must, therefore, be cut out from the large mega-boule. The present invention, advantageously introduces a cleave plane into the structure. During the stacking of the mega-boule, additional etchable fibers of suitably small size may be introduced into the areas surrounding each individual MCP. During the etch process, these fibers are etched away leaving only the clad glass in distinct patterns surrounding each individual MCP. After all of the processing is complete, the large mega-boule may be placed on a cleave plane and the individual plates broken out from the large mega-boule.

Returning to FIG. 5, after stacking the mega-boule to have a cross-sectional area of a predetermined size, the mega-boule is pressed into a monolithic stack in step 56. The pressing step may be performed, while mega-boule 62 is suspended in a furnace. The furnace may be heated at an elevated temperature, so that bundles 16 of mini-boules 66, bundles 16 (for example) of outer perimeter section 69, and support rods 24 of inner perimeter section 67 and support rods 24 of interstitial area 64 are softened. While mega-boule 62 is at its softening temperature point, the pressing step is effective in causing bundles 16 and non-etchable rods 24 to fuse together and form a monolithic stack.

Figure 10A:
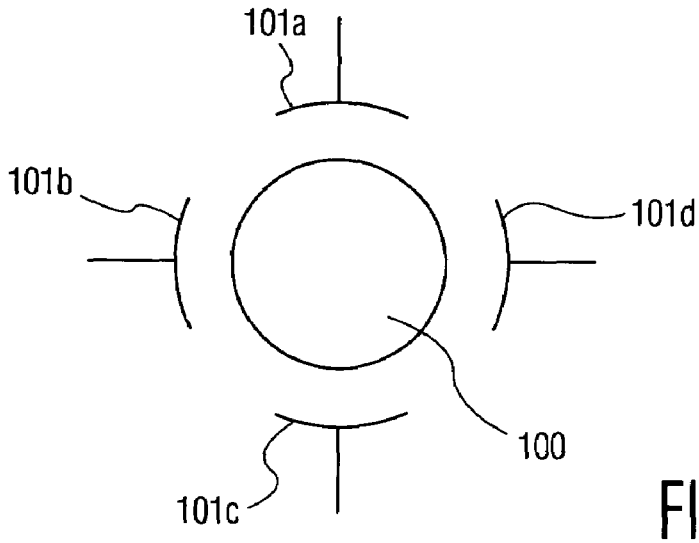
FIG. 10A is a schematic cross-sectional view of opposing arched-presses configured to press the monolithic stack of FIG. 6 into a circular geometry, in accordance with the present invention.
Figure 10B:
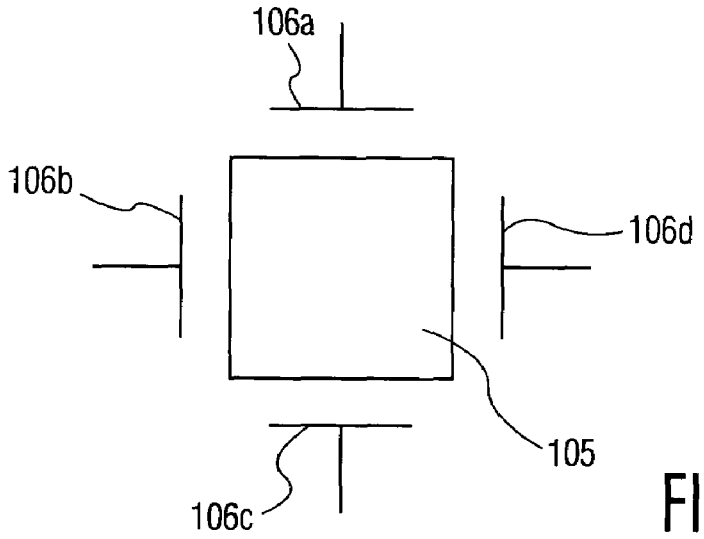
FIG. 10B is a schematic cross-sectional view of opposing linear presses configured to press the monolithic stack of FIG. 6 into a rectangular geometry, in accordance with the present invention.

It will also be appreciated that the cross-sectional area of the monolithic stack may be circular, rectangular, or of any other geometry compatible with semiconductor wafer fabrication tools. For example, mega-boule 62 may be stacked to form a substantially circular cross-sectional geometry and, subsequently, pressed into a circular monolithic stack 100 by opposing arched-presses 101*a*–101*d*, as exemplified in FIG. 10A. As another example, mega-boule 62 may be stacked to form a substantially rectangular cross-sectional geometry and, subsequently, pressed into a rectangular monolithic stack 105 by opposing linear-presses 106*a*–106*d*, as exemplified in FIG. 10B.

After the mega-boule is pressed into a monolithic stack, the pressed monolithic stack (100 or 105) is cut, in step 57, to form a cross-sectional size compatible with semiconductor wafer fabrication tools. For example, the monolithic stack may be turned on a lathe, or some other machine, to produce a circular mega-boule of circumference 68, as shown in FIG. 6.

Figure 11:
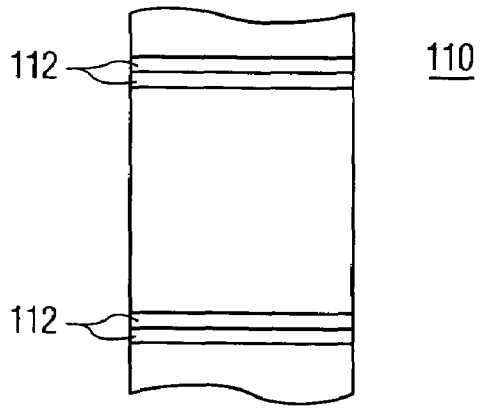
FIG. 11 is a side view of the monolithic stack of FIG. 6 being diced into multiple mega-boule wafers, in accordance with the present invention.

The cut monolithic stack is then sliced or diced, in step 58, into multiple mega-boule wafers, as schematically depicted in FIG. 11. As shown, monolithic stack 110 is diced cross-sectionally to produce a plurality of mega-boule wafers 112. Each mega-boule wafer 112 is now ready to be processed as a large batch die containing multiple MCPs. It will be appreciated that the large batch die (mega-boule wafer 112) is processed in the same manner as an individual MCP wafer is processed. Advantageously, however, the large batch die allows multiple MCPs to be concurrently produced with minimal human handling and contamination.

The method of the invention then takes each mega-boule wafer, formed by dicing in step 58, for further processing during step 59. The mega-boule wafer is heated and etched to remove the glass cores (cores 12 in FIG. 1) of mini-boules 66 and the glass cores of outer perimeter sections 69. Since the glass claddings (claddings 14 in FIG. 1) of mini-boules 66 and the glass claddings of outer perimeter sections 69 and the support rods have a higher lead content then the glass cores, they are non-etchable, under the same conditions used to etch the glass cores. Thus, the glass claddings and the support rods remain and become boundaries for the micro-channels (microchannels 32 in FIG. 4) formed in the mega-boule wafer and cleave planes for extraction of the individual MCPs. The etching process may be performed by using diluted hydrochloric acid.

Figure 4:
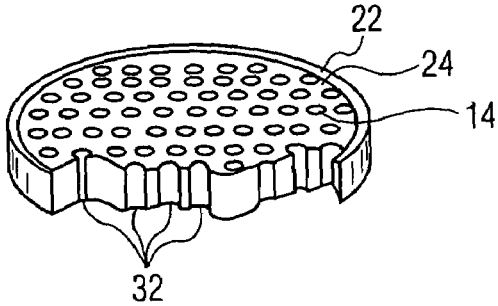
FIG. 4 is a partial cut-away view of a microchannel plate.

The mega-boule wafer is then placed in an atmosphere of hydrogen gas, whereby the lead oxide of the non-etched lead glass is reduced to render claddings 14 as electron emissive. In this way, a semi-conducting layer is formed in each of the glass claddings and this layer extends inwardly from the surface that bounds each microchannel 32 (FIG. 4).

Because support rods 24 become boundaries for each mini-boule 66, the active area of each microchannel plate is decreased. In this way, there are less channels to outgas. Additionally, since each MCP must be made to a predetermined outside diameter, so that it may be accommodated within an image intensifier tube, the area along the rim of each MCP is not used. The area along the rim is blocked by internal structures in the image intensifier tube. Therefore, support rods 24 may form a border of a predetermined area surrounding each mini-boule 66. This border may be the area along the rim of each MCP which is blocked by the internal structures of the image intensifier tube.

Thin metal layers are applied as electrical contacts to each of the planar end surfaces of the mega-boule wafer. This allows the establishment of an electric field across each MCP and provides entrance and exit paths for electrons excited by the electric field.

After activation and metallization, each mega-boule wafer may be connected to a test fixture, whereby each MCP in the mega-boule wafer may be simultaneously tested for proper operation.

If individual dies are required for producing each MCP, the mega-boule wafer may be processed, in step 60, to extract individual MCPs from the mega-boule wafer. The extraction may be performed by breaking along the cleave planes of the outer perimeter sections, so that each MCP is separated from the mega-boule wafer. The extraction should preferably be free from particle generation, in order to minimize contamination of the multiple MCPs.

Advantages of the present invention are many. The shape and size of the monolithic stack may depend on the type of semiconductor wafer fabrication tools available. The shape and size of the mega-boule wafer, which is diced from the monolithic stack, may also depend on the type of semiconductor wafer fabrication tools are available. Consequently, specialized tools may be avoided.

Furthermore, handling and particle defects may be reduced, because the processing tools are automated and limit the amount of human interaction with the MCP dies. Throughput may be increased, because a higher packing density of MCP dies is possible on the mega-boule wafer. This increases the batch size.

Moreover, tool fixture issues for different sizes of MCPs may be easily resolved, because the mega-boule wafer is the fixture that holds the individual MCP dies. Different MCP formats may easily be incorporated into a production line, because the mega-boule wafer is the fixture, and different MCP sizes may be accommodated in a single mega-boule wafer. Peculiar tools for each MCP size may thus be avoided. Although the stacking steps and dicing step may be different for different size requirements of MCPs, the tooling is the same for processing a mega-boule wafer, as a batch die of a predetermined cross-sectional area. This reduces capital costs.

In addition, after all the processing is complete, the large mega-boule may be placed on a cleave plane and the individual MCPs may be broken out from the large mega-boule, without laser scribing.

Figure 7:
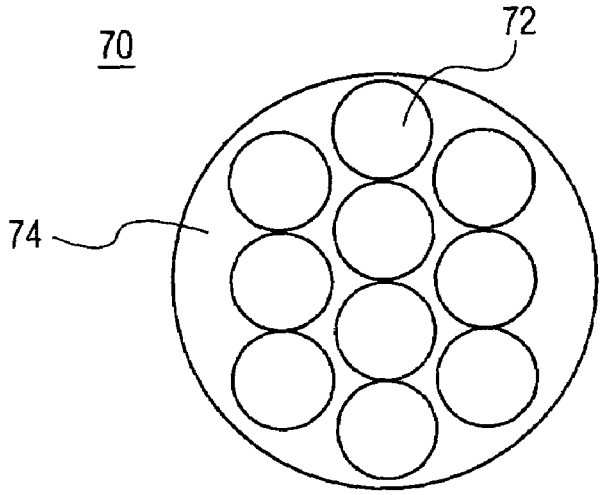
FIG. 7 is a cross-sectional view of a 4-inch semiconductor mega-boule wafer, illustrating that ten standard 18 mm MCPs may be extracted from the batch die, in accordance with the present invention.
Figure 8:
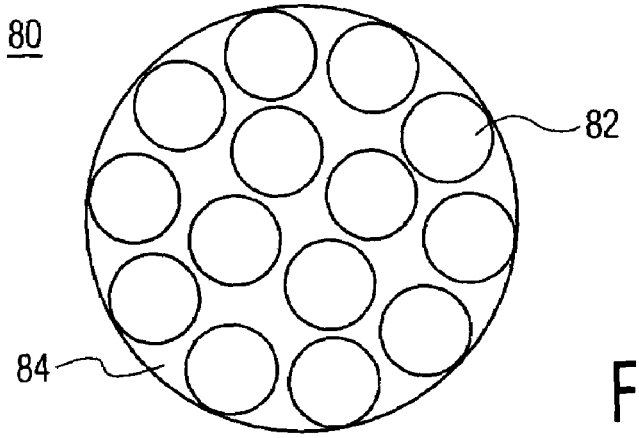
FIG. 8 is a cross-sectional view of a 4-inch semiconductor mega-boule wafer, illustrating that 14 standard 16 mm MCPs may be extracted from the batch die, in accordance with the present invention.

FIGS. 7–9 show different batch sizes for a 4-inch semiconductor mega-boule wafer. FIG. 7 illustrates that ten standard 18 mm MCPs, generally designated as 72, may fit within mega-boule wafer 70. The interstitial area, designated as 74, is the non-etchable glass left after the desired ten MCPs are removed from the 4-inch mega-boule wafer 70.

FIG. 8 illustrates that 14 standard 16 mm MCPs, generally designated as 82, may fit within 4-inch mega-boule wafer 80. The interstitial area, designated as 84, is the non-etchable glass left after the desired 14 MCPs are removed from the 4-inch mega-boule wafer 80.

FIG. 9 illustrates the flexibility of densely packing rectangular MCPs within 4-inch mega-boule wafer 90. As shown, a batch size of 28 MCPs, generally designated as 92, may fit within the 4-inch mega-boule wafer. The non-etchable glass left after the recantangular MCPs are removed is designated as 94. It should be understood, however, that the present invention is not limited to 4-inch mega-boule wafers. Other sizes may be used consistent with semiconductor fabrication tools.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A mega-boule for use in fabricating microchannel plates (MCPs), the mega-boule comprising a cross-sectional surface including an island section, an inner perimeter section and an outer perimeter section, each section occupying a distinct portion of the cross-sectional surface, wherein the island section is formed of a first plurality of optical fibers, transversely oriented to the cross-sectional surface, each optical fiber including a cladding formed of non-etchable material and a core formed of etchable material, the inner perimeter section is formed of non-etchable material and is disposed to surround the island section, and the outer perimeter section is formed of a second plurality of optical fibers, transversely oriented to the cross-sectional surface, each optical fiber including a cladding formed of non-etchable material and a core formed of etchable material, and the outer perimeter section is disposed to surround the island section and the inner perimeter section.

2. The mega-boule of claim 1 further including at least another section occupying a distinct portion of the cross-sectional surface, wherein the other section is formed of non-etchable material, and is separated from the inner perimeter section by the outer perimeter section.

3. The mega-boule of claim 2 wherein the first and second plurality of optical fibers and the non-etchable material of the inner perimeter section and the other section form a fused monolithic stack, when heated and pressed.

4. The mega-boule of claim 1 wherein the echable material and the non-etchable material are glass, and the non-etchable material includes a higher lead content than the etchable material.

5. The mega-boule of claim 1 wherein the non-etchable material of the inner perimeter section includes a plurality of support rods transversely oriented to the cross-sectional surface.

6. The mega-boule of claim 1 wherein the non-etchable material of the inner perimeter section includes a plurality of support rods transversely oriented to the-cross-sectional surface, and the first plurality of optical fibers of the island section and the plurality of support rods of the inner perimeter section are configured for use as an MCP.

7. The mega-boule of claim 1 wherein an optical fiber of the first plurality of optical fibers of the island section and an optical fiber of the second plurality of optical fibers of the outer perimeter section are substantially similar in cross-section.

8. The mega-boule of claim 1 wherein the first plurality of optical fibers of the island section form transverse microchannels for an MCP, when the island section is etched, and the second plurality of optical fibers of the outer perimeter section form perforated cleave planes, when the outer perimeter section is etched.

9. The mega-boule of claim 1 wherein the island section, the inner perimeter section and the outer perimeter section have one of a rectangular configuration and a circular configuration.

10. The mega-boule of claim 1 wherein the outer perimeter section and the island section form an MCP, and the outer perimeter section includes a sufficient cross-sectional width for forming perforated cleave planes to break away the MCP from the mega-boule, and for preventing the MCP die accidentally breaking away during fabrication of the MCP.

* * * * *